US005343659A

United States Patent [19]

Zaleski

[11] Patent Number: 5,343,659

[45] Date of Patent: Sep. 6, 1994

[54] SNOW GUARD

[76] Inventor: Joseph D. Zaleski, 49 Reservoir Rd., Farmington, Conn. 06032

[21] Appl. No.: 36,452

[22] Filed: Mar. 24, 1993

[51] Int. Cl.[5] ..... E04D 13/00

[52] U.S. Cl. ..... 52/24; 52/26

[58] Field of Search ..... 52/24, 25, 26

[56] References Cited

U.S. PATENT DOCUMENTS

| | | | |
|---|---|---|---|
| 625,144 | 5/1899 | Clark | 52/24 |
| 933,784 | 9/1909 | Peter | 52/24 |
| 1,647,345 | 11/1927 | Douglas | 52/24 |
| 3,296,750 | 1/1967 | Zaleski | 52/24 |

FOREIGN PATENT DOCUMENTS

| | | | |
|---|---|---|---|
| 2515236 | 4/1983 | France | 52/24 |
| 666147 | 2/1952 | United Kingdom | 52/25 |

*Primary Examiner*—Carl D. Friedman
*Assistant Examiner*—Kien Nguyen
*Attorney, Agent, or Firm*—McCormick, Paulding & Huber

[57] ABSTRACT

A snow guard has a two piece base with a top portion adapted to hook over a shingle and a bottom portion with an upstanding flange defined by lower portions of each piece of the base. A figurine cast in the shape of an eagle has a stem portion riveted to this flange so that the eagle's wings define a show shelf.

3 Claims, 1 Drawing Sheet

SNOW GUARD

SUMMARY OF THE INVENTION

This invention relates generally to snow guards that are adapted for use on pitched roofs, and more specifically for use on a shingled roof with parallel courses laid one on top of another. Such snow guards serve the purpose of holding back and breaking up snow and ice forming on the roof in order to prevent such snow and ice from sliding in heavy masses off the roof onto persons beneath.

Such snow guards should be attractive in appearance and of sufficient strength so as to withstand the forces imposed upon them by the snow and ice. Further, such devices should be designed for mounting between successive courses of shingles without disrupting the shingles themselves.

BACKGROUND OF THE INVENTION

The general purpose of the present invention is provide a relatively thin sheet metal snow guard having a web or shelf for holding the snow in a manner such that the snow guard is ornamentally pleasing to the eye, and such that sufficient strength is provided to support the snow and ice until it melts.

DETAILED DESCRIPTION

Figure 1:
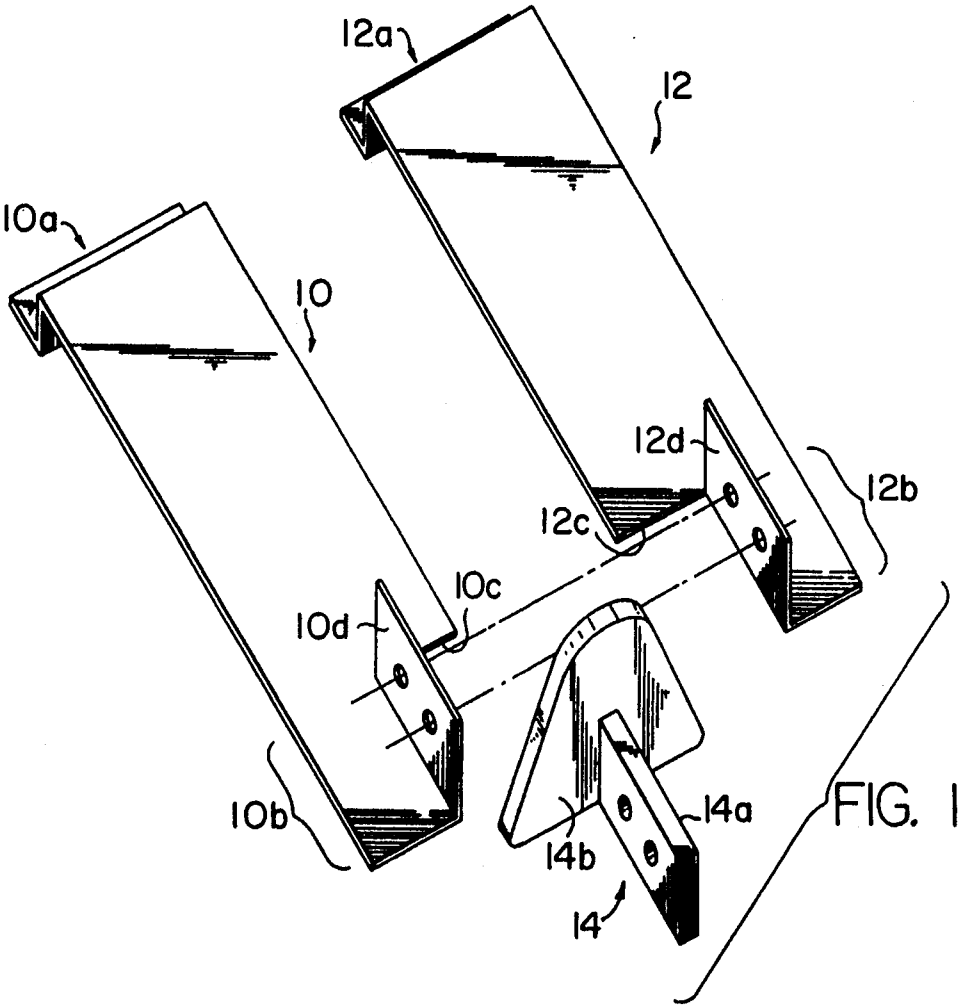
FIG. 1 is a perspective view showing in exploded relationship the various component parts of a snow guard constructed in accordance with the present invention.

FIG. 1 shows a pair of sheet metal strips 10 and 12, which strips have upper edges 10*a* and 12*a* respectively formed into a generally L-shape so as to permit the strips to be laid one over the another (as for example 12 over 10) with the result that the formed upper edges 10*a* and 12*a* are adapted to be hooked over the upper edge of a shingle, which single is partially overlapped by the next higher course of shingles in a typical pitched roof.

In accordance with conventional practice in the manufacture of sheet metal snow guards generally the metal from which the strips 10 and 12 are formed is preferably weather resistant and may comprise copper or aluminum or the like. The two strips 10 and 12 have a lower edge portion 10*b* and 12*b* respectively such that each has a lateral cut extending from one side edge of each strip to a medial center line of that particular strip. For example, the strip 10 has the lateral cut 10*c* extending from one edge generally to the center line of the strip 10 such that a flange 10*d* can be bent into a plane perpendicular to the strip and provided with openings for purposes of receiving rivets or other fasteners. On the other hand, the strip 12 has its lateral cut 12*c* provided in an opposite side edge of the strip 12 with the result that an upstanding flange 12*d* can be formed that will mate with the flange 10*d*. The result is a snow guard base that has the appearance of a single integrally formed base. The base actually comprises two strips laid one on top of another which strips define abutting flanges 10*d* and 12*d* that are adapted to receive a web or shelf for holding back the snow or ice.

Still in accordance with the present invention the snow guard of the invention includes a web or shelf provided adjacent its lower end which web or shelf may be cast so as to give it increased strength. As shown in FIG. 1 the web or shelf 14 is provided with an integrally formed stem portion 14*a* having openings that can be aligned with the openings provided in the abutting flanges 10*d* and 12*d* for purposes of securing the shelf 14 to the base, which base is made from two strips 10 and 12 and the rivets also secure the strips to one another as well.

Figure 2:
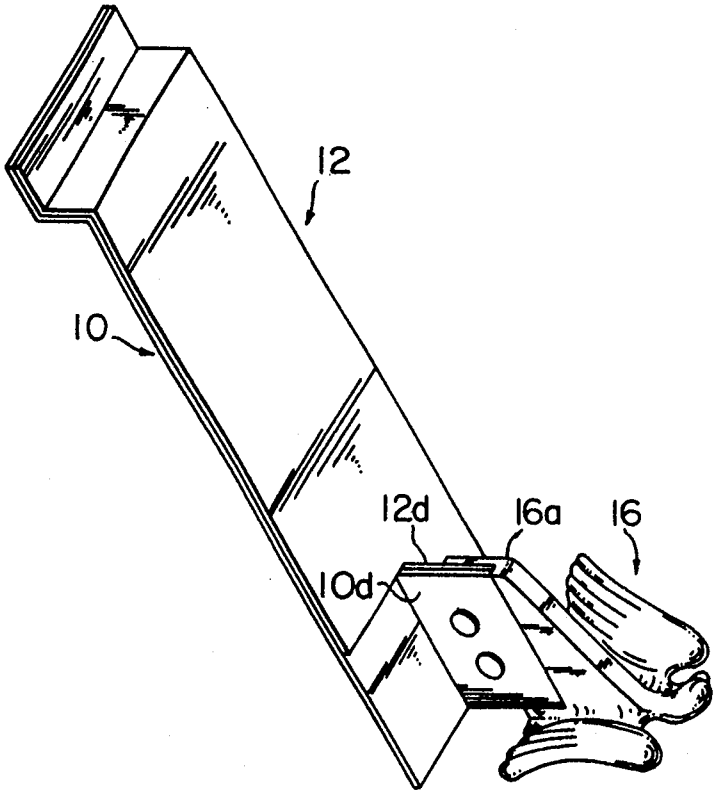
FIG. 2 is a perspective view of an alternative embodiment of the present invention illustrating a cast figurine which is so shaped that it defines the shelf portion of the snow guard.

Turning next to a description of FIG. 2, an alternative embodiment is there shown having strips 10 and 12 identical to those described previously with reference to FIG. 1, but instead of providing a straight forward shelf such as indicated generally at 14*b* in FIG. 1, the web or shelf of FIG. 2 is cast to define a figurine having a stem portion 16*a* which defines openings for purposes of securing the figurine shelf 16 to the base provided by the two strips 10 and 12. The figurine 16 of FIG. 2 is preferably an eagle with spread wings with the result that the wings are oriented in plane generally perpendicular both to the base defined by the two strips 10 and 12 and perpendicular to the abutting flanges 10*d* and 12*d*. As so constructed and arranged the cast eagle defines the snow shelf for the snow guard.

I claim:

1. A roof snow guard of the type adapted to be hooked over the upper edge of a shingle that is partially overlapped by the next higher course of shingles of a pitched roof, said guard including a base made from weather resistant sheet metal, said base having an elongated generally rectangular shape with a medial center line, at least two sheet metal strips laid one on top of the other, both said two strips having upper edges that are formed into a hook adapted to be hooked over the upper edge of a shingle, one of said two strips having a lower edge portion with a lateral cut extending from one side of said one strip to said medial center line, said other of said two strips having a lower edge portion with a lateral cut extending from an opposite side of said other strip to said medial center line, and said two strips having abutting flanges bent upwardly and extending along said medial center line, and a web or shelf secured to said abutting flanges.

2. The device according to claim 1 wherein said web or shelf comprises a cast figurine having a stem portion, and means for securing said cast figurine to said abutting flanges comprising at least one rivet, said rivet extending through both abutting flanges and through said stem portion of said cast figurine.

3. The device according to claim 2 wherein said figurine comprises an eagle figurine with wings, said wings oriented generally perpendicular to said base and to said abutting flanges.

* * * * *